US005693596A

United States Patent [19]

Kaburagi et al.

[11] Patent Number: 5,693,596

[45] Date of Patent: Dec. 2, 1997

[54] CUTTING FLUID, METHOD FOR PRODUCTION THEREOF, AND METHOD FOR CUTTING INGOT

[75] Inventors: Shingo Kaburagi; Akio Ashida, both of Tokyo; Etsuo Kiuchi; Kazuo Hayakawa, both of Gunma-ken; Kohei Toyama, Fukushima-ken, all of Japan

[73] Assignee: Shin-Etsu Handotai Co., Ltd., Tokyo, Japan

[21] Appl. No.: 553,722

[22] Filed: Oct. 23, 1995

[30] Foreign Application Priority Data

Oct. 25, 1994 [JP] Japan ..... 6-284235

[51] Int. Cl.[6] ..... C10M 125/30; C10M 173/02

[52] U.S. Cl. ..... 508/143; 508/146; 508/190; 508/283; 508/284; 508/297

[58] Field of Search ..... 508/137, 143, 508/144, 146, 190, 242, 283

[56] References Cited

U.S. PATENT DOCUMENTS

| | | | |
|---|---|---|---|
| 2,121,606 | 6/1938 | McCulloch | 508/137 |
| 3,266,923 | 8/1966 | Morway et al. | 508/144 |
| 3,377,278 | 4/1968 | Ruzza | 508/144 |
| 3,390,085 | 6/1968 | Floeck | 508/283 |
| 3,654,171 | 4/1972 | Emond et al. | 508/143 |
| 4,382,868 | 5/1983 | House | 508/143 |
| 4,464,274 | 8/1984 | House | 508/143 |
| 4,622,158 | 11/1986 | Walsh | 508/190 |
| 4,853,140 | 8/1989 | Payne et al. | 252/34 |
| 5,409,622 | 4/1995 | Chapman et al. | 508/137 |

FOREIGN PATENT DOCUMENTS

| | | |
|---|---|---|
| 974 127 | 2/1951 | France . |
| 04-216897 | 6/1992 | Japan . |
| 2 108 148 | 5/1983 | United Kingdom . |

OTHER PUBLICATIONS

Database WPI, Section Ch, RO 77 672 A (Inst Ing Tehn Rafinarri) 30 Oct. 1981, Romania.

*Primary Examiner*—Ellen M. McAvoy
*Attorney, Agent, or Firm*—Ronald R. Snider

[57] ABSTRACT

A water-soluble cutting fluid is produced by dissolving a polymer fatty acid triglyceride imidazole, 2-methyl-1-stearate, and boric acid imidazole in the dispersion of inorganic bentonite in water thereby preparing a main component and adding oleic acid (agent for enhancing the lubricity), Na salt of ethylenediamine tetraacetic acid (metallic ion adsorbent), benzotriazole (rust-preventing auxiliary agent), and a silicone type defoaming agent to the main component.

8 Claims, No Drawings

CUTTING FLUID, METHOD FOR PRODUCTION THEREOF, AND METHOD FOR CUTTING INGOT

BACKGROUND OF THE INVENTION

1. Field of the Invention

This invention relates to a cutting fluid (water-soluble cutting fluid) which is effective in cutting ingots such as silicon single crystal, polycrystal, compound semiconductor, and ceramics, a method for the production thereof, and a method for cutting an ingot by the use of the cutting fluid.

2. Description of the Prior Art

In the cutting fluids used for cutting ingots such as silicon single crystal, water-insoluble cutting oils having a mineral oil as a main component thereof have been occupying a dominant position. The practice of slicing an ingot while supplying to the point of cutting in the ingot a cutting agent (slurry) having such abrasive as SiC dispersed in the cutting oil has been in vogue. The slices produced from the ingot are forwarded through a cleansing step to the step of a subsequent treatment. The slurry which has been used in cutting the ingot is disposed of as waste.

The cleaning of the slices mentioned above aims to deprive the slices of such smears as the cutting oil adhering thereto. As cleaning liquids, those of the organic solvent type (such as, for example, trichloroethane and methylene chloride) have been heretofore used. These organic solvent type cleaning liquids are at an advantage in simplifying the work of cleaning.

The tools which are used for cutting such ingots include peripheral blades, internal blades, band saws, and wire saws, for example. In cutting ingots of relatively large diameters exceeding 3 inches, a wire saw or a band saw is dominantly used. This is because the wire saw or the band saw can remove slices of a uniform thickness from an ingot, repress the amount of inevitably griding powder, and produce a large number of wafers at a time as compared with the other cutting tools.

The cutting fluid having a mineral oil as a main component thereof is an inflammable and hazardous substance and, therefore, is at a disadvantage in lacking safety. For fear that the organic solvent type cleaning liquid mentioned above should form a major cause for cancerous growth and air pollution (destruction of the ozonosphere), the use of this cleaning liquid has been banned recently. As respects the slurry mentioned above, it is customary for the slurry, after being used for the cutting, to be disposed of as waste by incineration. This incineration likewise forms one of the causes for air pollution. Thus, the development of a safe alternative to the slurry has been longed for.

Further, in the cutting of an ingot, the ease with which the produced slices sustain warp (a convex in the central part of a slice) grows in accordance as the cutting speed increases. When a silicon single crystal ingot is sliced with a wire saw at a cutting speed of not less than 1 mm/min, for example, the warp in the produced slices possibly exceeds 20 μm. The warp of such a large size as this not only hinders the process of manufacture of such products as silicon wafers but also causes a decline of the yield.

This invention has been produced with a view to solving the problems of the prior art mentioned above. It is an object of this invention to solve the various problems encountered in the use of the conventional water-insoluble cutting oil such as presenting a fire hazard and entailing air pollution due to the use of an organic solvent during the course of cleaning an ingot ready to be cut and, at the same time, curb the occurrence of warp in the slices to be obtained by cutting from a silicon single crystal ingot of a large diameter.

SUMMARY OF THE INVENTION

The first aspect of this invention resides in a cutting fluid characterized by containing as main components thereof at least either inorganic bentonite or organic bentonite and the aqueous solution of a fatty acid imidazole.

The second aspect of this invention resides in the cutting fluid, wherein the fatty acid imidazole is a polymer fatty acid triglyceride imidazole and the cutting fluid contains 2-methyl-1-stearate as an additional component thereof.

The third aspect of this invention resides in the cutting fluid, wherein the fatty acid imidazole is a polymer fatty acid triglyceride imidazole and the cutting fluid contains boric acid imidazole and 2-methyl-1-stearate as additional components thereof.

The fourth aspect of this invention resides in the cutting fluid, wherein the cutting fluid further contains plural main agents or auxiliary agents selected from the group consisting of agents for improving water-retaining property, agents for improving water-washing property, agents for preventing sedimentation of abrasive, agents for improving dispersibility of abrasive, agents for improving lubricity, agents for improving cooling property, agents for improving permeability, agents for rust preventives, agents for rust-preventing auxiliaries, agents for improving resistance to freezing, auxiliary agents for recovery of viscosity, and defoaming agents.

The fifth aspect of this invention resides in a method for the production of a cutting fluid, characterized by dispersing at least either inorganic bentonite or organic bentonite in water, dissolving in the resultant dispersion a raw material liquid (1) containing a polymer fatty acid triglyceride imidazole obtained by the reaction of a polymer fatty acid glyceride with imidazole, then dissolving in the resultant solution oleic acid and a raw material liquid (2) containing 2-methyl-1-stearate obtained by the reaction of N-methyl-2-pyrrolidone with stearic acid further dissolving in the produced solution a raw material liquid (3) containing boric acid imidazole obtained by the reaction of imidazole with boric acid, and thereafter adding to the solution plural main agents or auxiliary agents including Na salt of ethylenediamine tetraacetic acid, benzotriazole, and silicone type defoaming agent.

The sixth aspect of this invention resides in a method for cutting an ingot such as silicon single crystal, characterized by slicing the ingot by a wire saw or a band saw in the presence of a dispersion having abrasive dispersed in the above cutting fluid as a cutting agent.

DESCRIPTION OF PREFERRED EMBODIMENTS

The cutting fluid according to this invention contains at least either inorganic bentonite or organic bentonite and the aqueous solution of a fatty acid imidazole as main components thereof. Generally, it is formed by combining such main raw materials and various auxiliary agents as shown below.

(A) Inorganic bentonite and organic bentonite (main raw material):

These compounds are cross-linked dispersants and function as an agent for preventing abrasive from sedimenting or as an agent for improving dispersibility of abrasive.

(B) Polymer fatty acid triglyceride imidazole (raw material liquid 1 ):

This compound, as a fatty acid imidazole, forms an effective recovery agent for retaining the dispersibility of abrasive and functions as an agent for enhancing the water-retaining property and concurrently serves as an auxiliary agent for enabling the cutting fluid to recover viscosity and as a rust preventive for the cutting fluid.

(C) 2-Methyl-1-stearate (raw material liquid 2):

Besides discharging the role of an agent for enhancing water-cleaning property, this compound functions as an agent for enhancing the dispersibility of abrasive, an agent for enhancing the lubricity of the cutting fluid (agent for lowering the friction coefficient), an agent for enhancing the cooling property, and an agent for enhancing the antifreezing property.

(D) Oleic acid (unsaturated fatty acid):

Besides serving as an agent for improving the lubricity of the cutting fluid (agent for lowering the friction coefficient), this compound forms an effective agent for enhancing permeability.

(E) Boric acid imidazole (raw material liquid 3):

This compound serves as a rust preventive for the cutting fluid.

(F) Na salt of ethylenediamine tetraacetic acid:

This compound functions as a metallic ion adsorbent (chelating agent). It is used in the form of 2Na to 4Na salt.

(G) Benzotriazole (tolyl triazole):

This compound serves as a rust preventing auxiliary agent for the cutting fluid.

(H) Silicone type defoaming agent:

This agent is an emulsion of dimethyl polysiloxane and plays the role of a deforming agent for the cutting fluid.

(I) Purified water:

This water functions as a solvent for the ionization of the cutting fluid.

The other raw materials which are usable for the production of the cutting fluid of this invention are enumerated below.

(1) N-methyl -2 -pyrrolidone:

This compound concurrently functions as a solvent for promoting the dissolution of a saturated fatty acid.

(2) Polymer fatty acid glyceride (3) Stearic acid (saturated fatty acid)

(4) Imidazole:

This compound forms one of the main raw materials for the cutting fluid and, at the same time, functions as an agent for enhancing viscosity and as rust preventive. It has a molecular formula, $C_4H_6N_2$, and is used in the form of 2 MZ.

(5) Boric acid:

This compound additionally functions as a rust preventive auxiliary agent for the cutting fluid.

The polymer fatty acid glyceride contains at least a carboxyl group. Appropriately, the polymer fatty acid glyceride has an average molecular weight of about 2,000.

In this invention, the polymer fatty acid glyceride obtained by the following methods (1) and (2) may be used.

In the method (1), a polysaturated fatty acid is isomerized and then is conducted to an addition reaction (Diels-Alder reaction) to obtain a multifunctional fatty acid, thereafter the multifunctional fatty acid is made to react with glycerol.

In the method (2), a monomer with the property of polymerization is conducted to an addition reaction with a carbon atom near to a double bond of a polyunsaturated fatty multifunctional fatty acid is made to react with glycerol.

In the method (1), the multifunctional fatty acid generally called dimer acid is desirably used.

The cutting fluid of this invention is manufactured, for example, by the following procedure:

1) Preparation of raw material liquid (1) (synthesis of polymer fatty acid triglyceride imidazole):

The purified water is kept heated at a temperature in the range of from 50° C. to 60° C. and the polymer fatty acid triglyceride is added thereto as retained in a stirred state. After they have been thoroughly stirred and allowed to return to the temperature of 50° C. to 60° C., imidazole 2 MZ is added thereto and left reacting therewith.

2) Preparation of raw material liquid (2) (synthesis of 2-methyl-1-stearate):

While a methyl-2-pyrrolidone solution is kept heated to a temperature in the range of from 60° C. to 70° C. and stirred at the same time, the saturated fatty acid (stearic acid) is added thereto and left reacting therewith.

3) Preparation of raw material liquid (3) (synthesis of boric acid imidazole):

As the purified water is heated to a temperature in the range of from 50° C. to 60° C. and, at the same time, kept stirred, the imidazole 2 MZ is added to the stirred water and, the dissolution is completed, the boric acid is added thereto and left reacting therewith.

4) Preparation of cutting fluid (1):

The bentonite is added to the purified water and dispersed therein by stirring, the raw material liquid (1) is dissolved in the resultant dispersion at room temperature, and the raw material liquid (2) mentioned above is added to the resultant solution and dissolved therein. Subsequently, the raw material liquid (3) is incorporated in the produced solution and dissolved therein and heated to a temperature in the range of from 50° C. to 60° C. and, thereafter, the unsaturated fatty acid (oleic acid) is dissolved therein. As a result, the main component liquid of the cutting fluid (1) is obtained. This main component liquid is mixed with the metallic ion adsorbent (chelating agent), such a rust preventing auxiliary agent as benzotriazole (tolyl triazole), and a silicone type defoaming agent to obtain a finished product.

The cutting fluid of this invention is used in the form of a slurry obtained by having abrasive mixed with and dispersed in the cutting fluid. Though it is particularly effective in cutting ingots which are formed of silicon single crystal or polycrystal, it can be extensively used in cutting compound semiconductor, ceramics, etc.

The cutting devices for which the cutting fluid is used effectively include wire saws and band saws and their multiple versions, i.e. multi-wire saws and multi-band saws. The cutting fluid can be alternatively used for the cutting devices using peripheral blades and inner blades.

The components and compositions of the raw material liquids (1) through (3) to be used for the production of the cutting fluid of this invention are as shown in Table 1 through Table 3 as standards.

TABLE 1

| Raw material liquid (1): polymer fatty acid triglyceride imidazole-containing liquid | |
|---|---|
| Raw material components | Composition (wt %) |
| Purified water | 62.0 to 71.0 |
| Polymer fatty acid glyceride | 19.0 to 24.0 |
| Imidazole 2MZ | 10.0 to 14.0 |
| Total | 100.0 |

TABLE 2

| Raw material liquid (2): 2-methyl-1-stearate-containing liquid | |
|---|---|
| Raw material components | Composition (wt %) |
| N-methyl-2-pyrrolidone | 72.0 to 79.0 |
| Saturated fatty acid (stearic acid) | 21.0 to 28.0 |
| Total | 100.0 |

TABLE 3

| Raw material liquid (3): Boric acid imidazole-containing liquid | |
|---|---|
| Raw material components | Composition (wt %) |
| Purified water | 74.0 to 79.0 |
| Imidazole 2MZ | 12.0 to 14.0 |
| Boric acid | 9.0 to 12.0 |
| Total | 100.0 |

The components and compositions of the cutting fluids produced by using the raw material liquids (1) through (3) mentioned above are as shown in Table 4 as standards.

TABLE 4

| Raw material components | Composition (wt %) |
|---|---|
| Purified water | 39.0 to 48.0 |
| Inorganic bentonite | 0.8 to 1.2 |
| Raw material liquid (1) | 13.1 to 15.0 |
| Raw material liquid (2) | 15.9 to 17.5 |
| Raw material liquid (3) | 14.1 to 16.2 |
| Unsaturated fatty acid (oleic acid) | 5.3 to 6.8 |
| 2Na salt of ethylenediamine tetraacetic acid | 0.8 to 1.2 |
| Benzotriazole (tolyl triazole) | 1.2 to 1.9 |
| Silicone type defoaming agent | 0.8 to 1.2 |
| Total | 100.0 |

Now, a working example of this invention and a comparative example involving a conventional cutting fluid will be described below.

EXAMPLE 1 AND COMPARATIVE EXAMPLE 1

The components and compositions of the raw material liquids (1) through (3) forming the cutting fluid of Example 1 are shown in Table 5 through Table 7 and the raw material components forming this cutting fluid and compositions thereof are shown in Table 8.

TABLE 5

| Raw materiai liquid (1): polymer fatty acid triglyceride imidazole-containing liquid | |
|---|---|
| Raw materiai components | Composition (wt %) |
| Purified water | 66.5 |
| Polymer fatty acid glyceride | 21.3 |
| Irnidazole 2Mz | 12.2 |
| Total | 100.0 |

TABLE 6

| Raw material liquid (2): 2-Methyl-1-stearate-containing liquid | |
|---|---|
| Raw material components | Composition (wt %) |
| N-methyl-2-pyrrolidone | 76.9 |
| Saturated fatty acid (stearic acid) | 23.1 |
| Total | 100.0 |

TABLE 7

| Raw material liquid (3): Boric acid imidazole-containing liquid | |
|---|---|
| Raw material components | Composition (wt %) |
| Purified water | 76.3 |
| Imidazole 2MZ | 13.2 |
| Boric acid | 10.5 |
| Total | 100.0 |

TABLE 8

| Raw material components | Composition (wt %) |
|---|---|
| Purified water | 42.7 |
| Inorganic bentonite | 1.0 |
| Raw material liquid (1) | 14.2 |
| Raw material liquid (2) | 16.9 |
| Raw material liquid (3) | 15.2 |
| Unsaturated fatty acid (oleic acid) | 6.5 |
| 2Na salt of ethylenediamine tetraacetic acid | 1.0 |
| Benzotriazole (tolyl triazole) | 1.5 |
| Silicone type defoaming agent | 1.0 |
| Total | 100.0 |

The physical properties of the cutting fluid of this invention and the water-insoluble cutting oil of the conventional example are shown in Table 9.

TABLE 9

| | This invention | Conventional example |
|---|---|---|
| Specific gravity (25° C.) | 1.027 | 0.898 |
| Viscosity (25° C.) (m · Pa · s) | 80 | 100 |
| pH (25° C.) | 8.46 | — |
| Surface tension (25° C.) (dyne/cm) | 30.6 | 31.8 |
| Flash point (°C.) (Cleveland open type) | None boils at 100° C. | 148 |

TABLE 9-continued

| | This invention | Conventional example |
|---|---|---|
| Friction coefficient | 0.087 | 0.092–0.100 |
| COD (mg/l) (aqueous 1% solution) | 6616 | — |

Slurries were prepared by having 1.5 kg of abrasive (SIC abrasive, GC #600, average particle diameter 19 to 20 μm) mixed with and dispersed in 1.0 to 1.5 liters respectively of the cutting fluid of this invention and the conventional cutting oil. With a multi-wire saw having a wire diameter of 0.18 mm and used at a tension of 3.0 kgf, an ingot of silicon single crystal was cut at a cutting speed of 1 mm/min in the presence of each slurry to obtain slices having a wall thickness of 0.75 mm.

In the case of the slurry using the cutting fluid obtained in Example 1 of this invention, the warps (the maximum value of the difference of height between the convexly deformed central part and the peripheral part) formed in 100 slices cut from an ingot 8 inches in diameter were invariably not more than 20 μm.

In contrast, in the case of the slurry using the conventional cutting oil obtained in Comparative Example 1, the warps formed were not more than 20 μm in 96 of 100 slices similarly produced from an ingot 8 inches in diameter.

As demonstrated above, the water-soluble cutting fluid of this invention produced the same results of ingot cutting as the conventional water-insoluble cutting oil.

It is clearly noted from the description given thus far that the cutting fluid of this invention allows an ingot such as of silicon single crystal having a large diameter to be cut at the same speed as is attained by the conventional cutting oil into slices forming no marked warp.

Since the cutting fluid of this invention is soluble in water, it is at an advantage in precluding the otherwise inevitable fire hazard and enabling the smear of cutting fluid adhering to produced slices to be thoroughly removed by washing with water. As respects the disposal of the waste from the washing, since the existing apparatus for waste water disposal can be utilized without requiring any modification and the slurry spent in the cutting can be similarly disposed of. Thus, the disposal in this case has no possibility of inducing air pollution unlike the disposal by the use of the conventional organic solvent type cutting fluid. Further, since the cutting fluid of this invention contains no amine type compound, it has no possibility of entailing cancerous growth.

What is claimed is:

1. A cutting fluid comprising at least either inorganic bentonite or organic bentonite, a fatty acid imidazole and a major amount of water.

2. A cutting fluid comprising 0.8–1.2% by weight of at least either inorganic bentonite or organic bentonite, 3.8–5.7% by weight of polymer fatty acid triglyceride imidazole and a residual major amount of water.

3. A cutting fluid comprising 0.80–1.20% by weight of at least either inorganic bentonite or organic bentonite, 3.80–5.70% by weight of polymer fatty acid triglyceride imidazole, 15.90–17.50% by weight of 2-methyl-1-stearate, and a residual major amount of water.

4. A cutting fluid comprising 0.80–1.20% by weight of at least either inorganic bentonite or organic bentonite, 3.80–5.70% by weight of polymer fatty acid triglyceride imidazole, 15.90–17.50% by weight of 2-methyl-1-stearate, 2.96–4.21% by weight of boric acid imidazole and a residual major amount of water.

5. A method for the production of a cutting fluid, characterized by dispersing at least either inorganic bentonite or organic bentonite in water, dissolving in the resultant dispersion a raw material liquid (1) containing a polymer fatty acid triglyceride imidazole obtained by the reaction of a polymer fatty acid glyceride with imidazole, then dissolving in the resultant solution oleic acid and a raw material liquid (2) containing 2-methyl-1-stearate obtained by the reaction of N-methyl-2-pyrrolidone with stearic acid, further dissolving in the produced solution a raw material liquid (3) containing boric acid imidazole obtained by the reaction of imidazole with boric acid, and thereafter adding to the solution plural main agents or auxiliary agents including Na salt of ethylene diamine tetraacetic acid, bezotriazole, and silicone type defoaming agent.

6. A method for cutting an ingot such as silicon single crystal, characterized by slicing said ingot by a wire saw or a band saw in the presence of a dispersion having abrasive dispersed in a cutting fluid comprising 0.8–1.2% by weight of at least either inorganic bentonite or organic bentonite, 3.8–5.7% by weight of polymer fatty acid triglyceride imidazole and a residual major amount of water.

7. A method for cutting an ingot such as silicon single crystal, characterized by slicing said ingot by a wire saw or band saw in the presence of a dispersion having abrasive dispersed in a cutting fluid comprising 0.8–1.2% by weight of at least either inorganic bentonite or organic bentonite, 3.8–5.7% by weight of polymer fatty acid triglyceride imidazole, 15.90–17.50% by weight of 2-methyl-1-stearate and a residual major amount of water.

8. A method for cutting an ingot such as silicon single crystal, characterized by slicing said ingot by a wire saw or band saw in the presence of a dispersion having abrasive dispersed in a cutting fluid comprising 0.8–1.2% by weight of at least either inorganic bentonite or organic bentonite, 3.8–5.7% by weight of polymer fatty acid triglyceride imidazole, 15.90–17.50% by weight of 2-methyl-1-stearate, 2.96–4.21% by weight of boric acid imidazole and a residual major amount of water.

* * * * *